US006412371B1

(12) United States Patent
Storm

(10) Patent No.: US 6,412,371 B1
(45) Date of Patent: Jul. 2, 2002

(54) SCREWING TOOL WITH A CLAMPING HOOP

(75) Inventor: Siegfried Storm, Schlangen (DE)

(73) Assignee: Weidmüller Interface GmbH & Co., Detmold (DE)

( * ) Notice: Subject to any disclaimer, the term of this patent is extended or adjusted under 35 U.S.C. 154(b) by 0 days.

(21) Appl. No.: 09/615,948

(22) Filed: Jul. 13, 2000

(30) Foreign Application Priority Data

Jul. 13, 1999 (DE) ..... 299 12 232 U

(51) Int. Cl.[7] ..... B25B 13/28
(52) U.S. Cl. ..... 81/99; 81/176.3
(58) Field of Search ..... 81/176.2, 176.3, 81/92, 94, 97, 98, 99, 100, 129, 129.5, 134, 135, 136

(56) References Cited

U.S. PATENT DOCUMENTS 1,006,348 A * 10/1911 Beran ..... 81/176.3
1,406,910 A * 2/1922 Sutherland ..... 81/99
1,672,804 A * 6/1928 Conrad ..... 81/99
2,953,050 A * 9/1960 Nolen ..... 81/99
3,109,334 A * 11/1963 Miranda ..... 81/99
3,195,381 A 7/1965 Meggs, Jr. et al.
3,661,041 A 5/1972 Welz
5,018,412 A 5/1991 Wylie, III

FOREIGN PATENT DOCUMENTS

CH A5602282 7/1978

* cited by examiner

*Primary Examiner*—Eileen P. Morgan
*Assistant Examiner*—Joni B. Danganan
(74) *Attorney, Agent, or Firm*—Birch, Stewart, Kolasch & Birch, LLP

(57) ABSTRACT

A screwing tool has a handle and a clamping hoop, which is mounted pivotably on the handle at one end and is bent in the form of a partial circle at its other end, which is remote from the handle. A stop for the clamping hoop is secured on the handle on the concave side of the clamping hoop. A return device on the handle presses the clamping hoop against the stop. An actuating member is held by the handle and the free end of which lies opposite to and at a distance from the concave side of that end of the clamping hoop which is bent in the form of a partial circle.

14 Claims, 2 Drawing Sheets

SCREWING TOOL WITH A CLAMPING HOOP

FIELD OF THE INVENTION

The invention relates to a screwing tool.

DESCRIPTION OF THE RELATED ART

Screwing tools for components having a polygonal circumference are already generally known. These screwing tools can be open-ended spanners, ring spanners etc., which can also be used to screw cable glands with a heavy-gauge thread. These cable glands are used frequently in combination with electrical switch cabinets when it is a matter of making line connections to the inside or the outside. However, there is often a problem in that cable glands of this kind are very close together in switch cabinets, with the result that relatively strong open-ended spanners cannot be used since their arms cannot be inserted in the region between adjacent cable glands. Moreover, the open-ended spanners applied to the cable glands have to be removed and reapplied after only a small angle of rotation. This is relatively troublesome. Ring spanners cannot be used for the stated purpose of securing cable glands on the switch cabinet or removing cable glands from the switch cabinet since generally cables have been passed through the cable glands, and a ring spanner can therefore not be applied to the cable gland, that is to say to the hexagon belonging to the cable gland. The same applies to conventional ratchet spanners. The cable which is usually present prevents them from being applied to the cable gland too.

BRIEF SUMMARY OF THE INVENTION

The object on which the invention is based is to make available a screwing tool for components which have a polygonal circumference that requires only a small amount of space to actuate the components and can also be used when material in the form of a strand has been passed through the component to be screwed. At the same time, it should be possible to carry out the screwing operation completely without having to reposition the screwing tool on the component after only a short angle of rotation.

A screwing tool according to the invention comprises: a handle; a clamping hoop, which is mounted pivotably on the handle at one end and is bent in the form of a partial circle at its other end, that remote from the handle; a stop for the clamping hoop, which is secured on the handle on the concave side of the clamping hoop; a return device on the handle, which device presses the clamping hoop against the stop; and an actuating member, which is held by the handle and the free end of which lies opposite to and at a distance from the concave side of that end of the clamping hoop which is bent in the form of a partial circle.

A screwing tool of this kind allows screwing of even very closely adjacent elements to be screwed since the clamping hoop can be made very thin, particularly in its region bent in the form of a partial circle, and this also applies to the actuating member held by the handle. Since there is furthermore always a gap between the free end of the actuating member and that end of the clamping hoop which is bent in the form of a partial circle, the screwing tool can also be applied easily to elements to be screwed, through which material in the form of a strand passes along the screwing axis of the said elements. Moreover, the return device means that the clamping hoop can yield, thus allowing the screwing tool to be operated in the manner of a ratchet in order in this way to be able to carry out a complete screwing operation which does not require the screwing tool to be repeatedly applied to the element to be screwed.

By means of the screwing tool according to the invention, it is possible, in particular, to considerably simplify the screwing operation in the case of cable glands with heavy-gauge threads on electrical switch cabinets since these cable glands are often extremely inaccessible and are furthermore positioned very close together.

According to an advantageous refinement of the invention, the clamping hoop has in the region of its end bent in the form of a partial circle, on its concave or inner side, driver projections spaced apart in the circumferential direction, which ensure that a component with a polygonal circumference is taken along better while being screwed rather than leaving this task solely to the free end of the actuating member. Torques can therefore be transmitted better to the element to be screwed.

According to another refinement of the invention, starting from the free end of the clamping hoop bent in the form of a partial circle, the driver projections are constructed in such a way, in the circumferential direction of the said hoop, that they first of all rise slowly, more specifically in the direction of the centre of the partial circle, and then fall suddenly. This thus results in a kind of sawtooth. The steep flank of the sawtooth points away from the free end of that end of the clamping hoop which is bent in the form of a partial circle. This gives a good driving effect on the element to be screwed when the screwing tool is moved in the screwing direction while, when the screwing tool is moved in the opposite direction, the gently rising flanks of the driver projections can slide over the edges of the element to be screwed more easily when the clamping hoop is deflected. This facilitates ratchet operation.

The clamping hoop and, with it, its bent end and the actuating member preferably lie in one and the same working plane. As a result the force can be transmitted more evenly to the element to be screwed. In addition, however, the handle can also extend in this working plane, leading to a very compact screwing tool.

A compression spring arranged between the convex side of the clamping hoop and the handle can preferably be used as the return device, leading to a relatively economical construction of the screwing tool.

In this arrangement, the handle can be in the form of a housing in order to accommodate the rotatably mounted end of the clamping hoop, the rear end of the actuating member and its direction of displacement, the stop and the return device. For example, the handle in the form of a housing may be capable of being divided parallel to the working plane and comprise a trough-shaped first part and a second part in the form of a cover.

According to yet another refinement of the invention, the handle can also have a chamber for the purpose of accommodating a second clamping hoop, the chamber being situated, for example, in the trough-shaped first part. The clamping hoop stored here can be thought of as a replacement for the clamping hoop already attached to the front of the handle, or the clamping hoop mounted by way of storage in the housing can be one with a different opening range.

In yet another refinement of the invention, the actuating member is mounted displaceably to allow adjustment of the distance between its free end and that end of the clamping hoop which is bent in the form of a partial circle, thereby making it possible to screw elements of different sizes as well, that is to say, for example, elements which have a different opening width. For this purpose, the free end of the actuating member is moved towards or away from the free end of the clamping hoop.

At the same time, there can be a device for locking the displacement position of the actuating member on the handle, making it easier to position and, of course, fix in the desired position.

For example, the locking device can have projections arranged on the actuating member or on an element which displaces the actuating member, the projections latching into recesses on the inner side of the handle.

However, it is also possible to provide a locking device which has a pawl, the pawl being mounted pivotably on the handle and one end of it being latchable to the actuating member. For this purpose, the actuating member can, for example, have a suitably designed row of teeth or other structures. The pawl can preferably be pivoted into the locking position by means of spring force by means of its other end, which projects from the handle. Reliable locking of the actuating member is thus achieved. It can be cancelled by pivoting this projecting end manually against the spring force.

To avoid unintentional actuation of the locking device or pawl, beads situated to the side of it, on the outside of the handle, can be provided.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

Exemplary embodiments of the invention are explained in greater detail below with reference to the drawings which are given by way of illustration only, and thus are not limitative of the present invention, and in which.

DETAILED DESCRIPTION OF THE INVENTION

Figure 1:
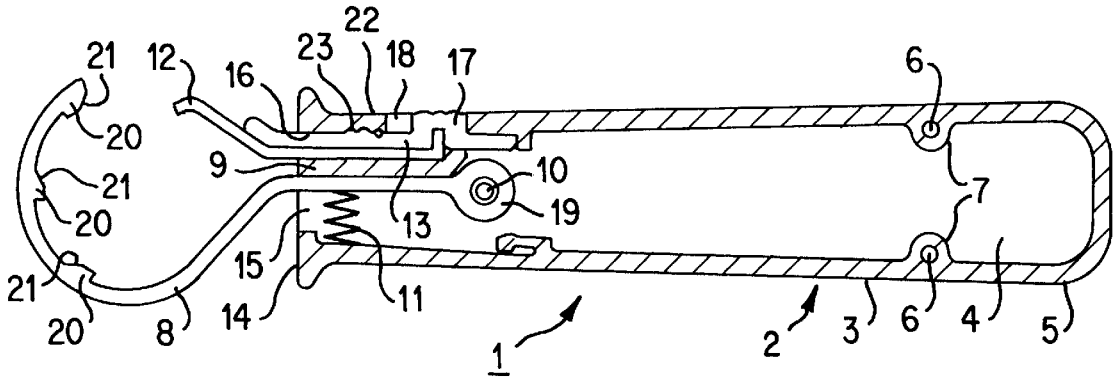
FIG. 1 shows a side view of the screwing tool with the cover removed.
Figure 2:
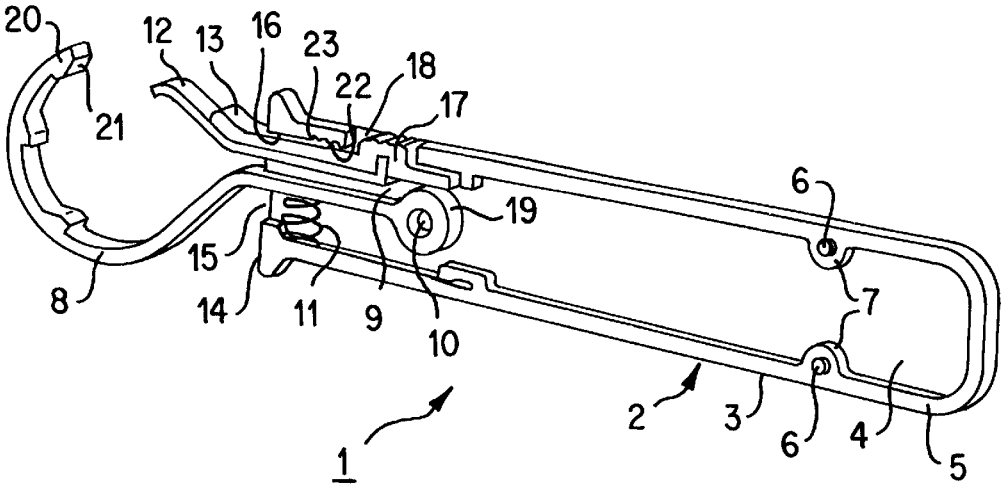
FIG. 2 shows a perspective view of the screwing tool with the cover removed.

In FIGS. 1 and 2, a first exemplary embodiment of a screwing tool according to the invention is provided with the reference numeral 1. The screwing tool 1 includes, inter alia, a handle 2, which is elongated in design and relatively narrow. Thus its length can be about 12 cm, its height about 2 cm and its depth (perpendicular to the plane of the drawing) about 1 cm. The handle 2 essentially comprises two parts, namely a base shell 3 shown in FIGS. 1 and 2 and a cover (not shown), which can be placed on the base shell 3 and can be designed as a flat plate. The base shell 3 has a base 4 and an encircling rim 5, which projects perpendicularly from the base 4. The cover (not shown) is then placed on the free edge of the encircling rim 5 and screwed to the base shell 3 using screws (not shown). For this purpose, the screws are inserted into openings in the cover and screwed into threaded holes 6 located in the region of thickened portions 7 of the rim 5. Only two of these threaded holes 6 and thickened portions 7 are shown in FIGS. 1 and 2. They are situated in the rear region of the handle 2. Corresponding threaded holes can be present in further thickened portions or other features at the front of the handle 2.

The cover (not shown) and the base shell 3 are divided in a working plane which, in the present case, is the plane of the drawing.

That part of the handle 2 which is on the left in FIGS. 1 and 2 is referred to as the front region. In this region there is a clamping hoop 8, a stop 9 for the clamping hoop 8, a pivot 10 for the clamping hoop 8, a return device, designed as a compression spring 11, for the clamping hoop 8, an actuating member 12 and an actuating slide 13 for displacing the actuating member 12. In this arrangement, the clamping hoop 8 and the actuating member 12 and the actuating slide 13 project out of the handle 2 through a front end 14 of the handle 2. For this purpose, there are corresponding through openings 15 for the clamping hoop 8 and 16 for the actuating member 12 and actuating slide 13 within the rim 5, in the region of the front end 14. An actuating portion 17 of the actuating slide 13 projects through an opening 18 in the upper region of the rim 5 and is thus accessible from outside.

The construction of the front part of the screwing tool 1 according to the invention will be described in greater detail below.

A more detailed description will first of all be given of the clamping hoop 8. This clamping hoop 8 is composed of relatively hard or inelastic material, hardened steel for example, and has a thickness of 1 to 2 mm and a width of about 5 mm. It extends in the working plane, which, as already explained, is the plane of the drawing in the present case. In its rear part, on the right in FIG. 1, the clamping hoop 8 extends in a relatively rectilinear manner and is widened, at its free, rearward-pointing end, to form a lug 19, which is provided with a through opening through which the pivot 10 projects. For its part, the pivot 10 can be anchored in a fixed manner to the base 4 of the base shell 3, e.g. connected integrally to the latter. The clamping hoop 8 can then be pivoted about this pivot 10. The clamping hoop 8 is prevented from slipping off the pivot 10 by the fact that the cover (not shown) mounted on the base shell 3 prevents displacement of the clamping hoop 8 in the longitudinal direction of the pivot 10. The pivot 10 is perpendicular to the working plane.

In its front region, on the left in FIGS. 1 and 2, which projects from the handle 2, the clamping hoop 8 is bent in the form of a partial circle. Starting from its rectilinear profile within the handle 2, the clamping hoop 8 is first of all bent downwards after emerging from the handle 2 and then back upwards in the form of a semicircle in the present case. This semicircle thus formed of the clamping hoop 8 serves to receive an element to be screwed, for example to receive a hexagon of a cable gland with a heavy-gauge thread. In this arrangement, there is a plurality of driver projections 20 on the inside or concave side of the semicircular part of the clamping hoop 8. These driver projections 20 project inwards from the clamping hoop 8 towards the centre of the semicircular region of the clamping hoop 8 and have a relatively flat run-on bevel 21 which rises in the direction of extension of the clamping hoop 8, viewed in the direction of the pivot 10. After reaching a plateau, the respective driver projection 20 then falls back very rapidly to the thickness of the clamping hoop 8, each of the driver projections 20 thus forming a kind of sawtooth. The steep flanks of the driver projections 20 serve to drive the element to be screwed, while the run-on bevels 21 facilitate ratchet operation of the screwing tool 1, as will be explained below.

As already mentioned, the clamping hoop 8 passes through the front opening 15 of the handle 2 and there comes to rest against a stop 9, which is here designed as a horizontal plate. This horizontal plate is perpendicular to the base 4 of the base shell 3 and can, for example, be connected integrally to the said base. In this arrangement, the longitudinal direction of the plate 9 is the same as the longitudinal direction of the handle 2. The rectilinear part of the clamping hoop 8 thus rests in parallel against the plate-shaped stop 9. This stop extends to just in front of the lug 19.

By means of the compression spring 11, the rectilinear region of the clamping hoop 8 is pressed against the stop 9. For this purpose, the compression spring 11 lies between the rectilinear region of the clamping hoop 8 and the rim 5 of the base shell 3, the said rim being at the bottom in FIGS. 1 and 2. There may be appropriate positioning means for the compression spring 11 but these are not shown here for the sake of clarity.

The actuating member 12 already mentioned and the actuating slide 13 are positioned in the region between the stop 9 and the upper rim 5 of the base shell 3 in FIGS. 1 and 2 and, in the present case, are essentially offset forwards relative to the pivot 10.

Here, the actuating member 12 is composed of the same material as the clamping hoop 8 and also has the same thickness dimensions and width dimensions. In the interior of the handle 2, the actuating member 12 is of essentially rectilinear design and is supported in a sliding manner on the plate-shaped stop 9. Here, therefore, the actuating member 12 and the stop 9 run parallel to one another. In its rear region, the actuating member 12 is angled vertically upwards away from the stop 9 and there engages from below in an actuating portion 17, which is part of the actuating slide 13. This actuating portion 17 comes to rest in the opening 18 in the upper rim 5 of the base shell 3 and is thus accessible from outside. The opening 18 is longer in the longitudinal direction of the handle 2 than the actuating portion 17 in this direction, with the result that the actuating portion 17 can be displaced in the opening 18, allowing the actuating member 12 to be displaced in the longitudinal direction of the handle 2 by means of this displacement. The actuating slide 13 rests directly on the actuating member 12 and on that side of the actuating member 12 which faces away from the stop 9. The actuating member 12 and the actuating slide 13 furthermore both pass through the through opening 16 in the end region 14 of the handle 2 and are guided there. In this arrangement, the actuating slide 13 can be provided on its side facing away from the actuating member 12 with a projection 22 that can engage in one of several recesses 23, which are located on the inside of the upper rim 5 of the base shell 3 to enable the actuating member 12 or actuating slide 13 to be fixed in a particular displacement position.

In the region outside the handle 2, the actuating member 12 is angled relative to its horizontal region situated in the handle 2, in particular away from the clamping hoop 8. In this angled region, the actuating member 12 initially likewise extends in a straight line and is then bent towards the clamping hoop 8 again in its free end region. In this arrangement, the free end of the actuating member 12 comes to lie approximately in a position on the circumference of a circle which would be obtained if the partial circle formed by the clamping hoop 8 were completed to give a full circle. In other words, the position of the free end of the actuating member 12 corresponds approximately to a position on the circumference of one of the driver projections 20. As an alternative, the actuating member 12 can extend outside the handle 2 and parallel to its straight region situated in the interior of the handle 2 and then be angled towards the clamping hoop 8 at the external free end.

The operation of the screwing tool 1 according to the invention will be explained below.

If the screwing tool 1 is to be used on a hexagon, for example, a cap of a cable gland with a heavy-gauge thread for instance, the screwing tool 1 is placed axially on the part to be screwed by means of its clamping hoop 8 bent in the form of a partial circle. If the part to be screwed is passed through by material in the form of a strand extending in the axial direction of the said part, this material in the form of a strand could first pass through the gap between the free end of the clamping hoop 8 and the free end of the actuating member 12. If the outside diameter of the component to be screwed does not correspond to the inside diameter of that region of the clamping hoop 8 which is bent in the form of a partial circle, the actuating member 12 can be moved up to the component to be screwed by displacing the actuating slide 13 so that the said actuating member is as close as possible to the component. As the clamping hoop 8 is placed on the component to be screwed, it can be swung away from the stop 9 to facilitate placement. Once the clamping hoop 8 has been placed on the component to be screwed, the clamping hoop 8 and the actuating member 12 are relatively close to it. If the tool 1 is now moved around the centre of the partial circle formed by the clamping hoop 8 as the handle is turned in the anticlockwise direction in FIGS. 1 and 2, the component lying between the clamping hoop 8 and the actuating member 12 is taken along and screwed in a corresponding manner. The clamping hoop 8 cannot yield during this movement. It continues to rest against the stop 9. If, on the other hand, the tool 1 in FIGS. 1 and 2 is swung clockwise around the centre formed by the partial circle of the clamping hoop 8, there is a relative rotation between the handle 2 and the clamping hoop 8 about the pivot 10, leading to the opening of the mouth formed by the clamping hoop 8 and the actuating member 12, thereby allowing the run-on bevels 21 or driver projections 20 to slide over the edges of the component to be screwed and to grip the latter again when the handle 2 is once again swung in the opposite direction.

The clamping hoop 8 must be placed axially on the component either on one side or the other, depending on whether the component to be screwed is to be tightened or loosened.

Figure 4:
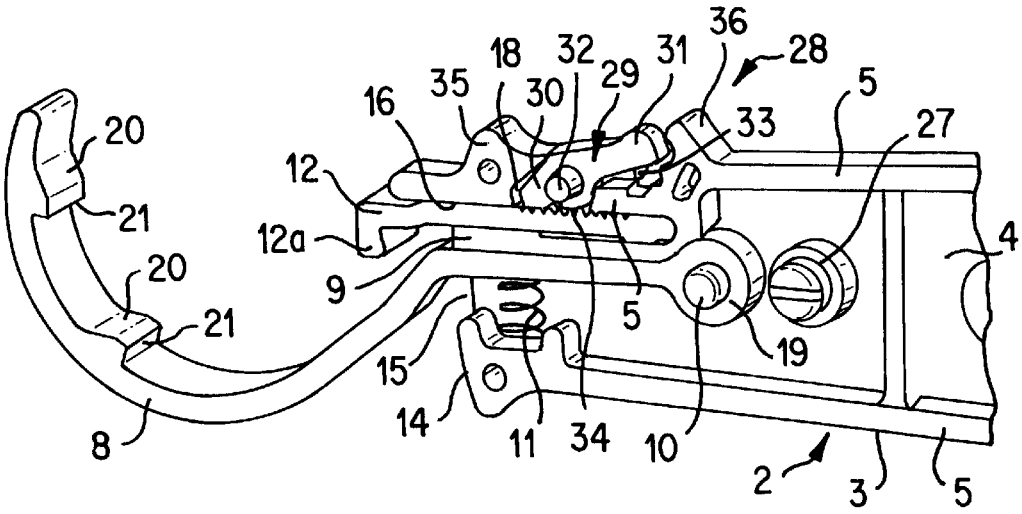
FIG. 4 shows an enlarged representation of the screwing tool shown in FIG. 3 in the region of its clamping hoop.

FIGS. 4 and 5 show a second exemplary embodiment of the screwing tool 1 according to the invention. Parts which are the same as those in FIGS. 1 and 2 are provided with the same reference numerals and are not described again. With regard to screwing, the operation of the second exemplary embodiment is identical with that of the first exemplary embodiment and this will therefore not be explained again either.

The screwing tool according to the second exemplary embodiment differs from that according to the first exemplary embodiment first of all in that a chamber 24 for the purpose of receiving another clamping hoop 8*a* is formed within the base shell 3 in the rear region of the handle 2. Within this chamber 24 there can be a stud 25 which is firmly connected to the handle 2 and on which a lug 19*a* of the other clamping hoop 8*a* can be placed, the said lug having an appropriate through opening for this purpose. The chamber 24 can furthermore be provided with ribs 26, the position of which is chosen so that the additional clamping hoop 8*a* stored in the handle 2 can move as little as possible. This additional clamping hoop 8*a* is intended as a replacement for the clamping hoop 8, for instance, and therefore has the same opening range as the latter, or it can be intended as a supplement to it if it has a different opening range from the clamping hoop 8.

Figure 3:
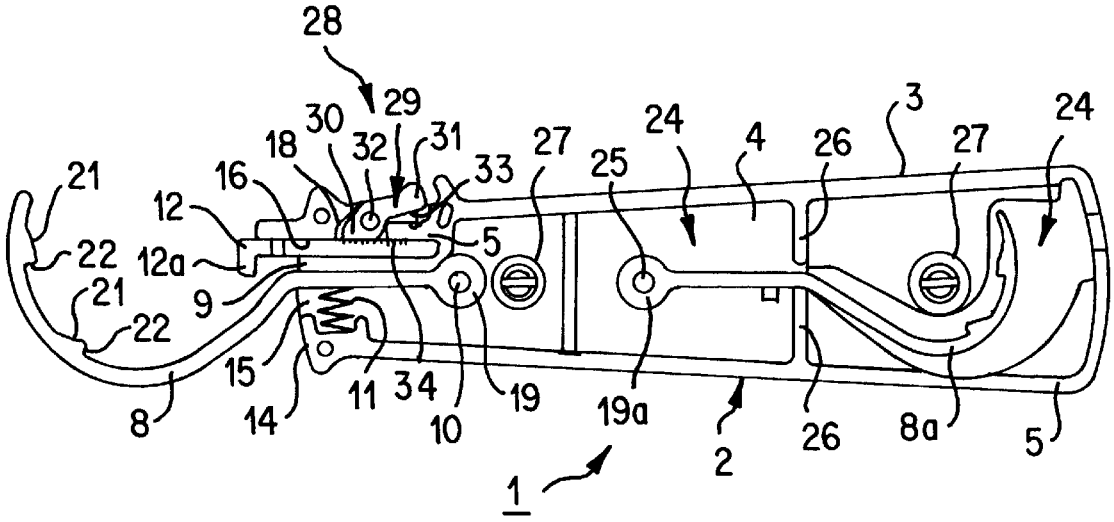
FIG. 3 shows a side view of another exemplary embodiment of the screwing tool according to the invention with the cover removed.

The base shell 3 of the screwing tool shown in FIG. 3 can also be closed by a cover (not shown). In this arrangement, the cover can be screwed to the base shell 3, for which purpose there are appropriate lugs 27 with threaded holes.

At the front, the screwing tool shown in FIGS. 3 and 4 has a locking device 28 with a pawl 29.

This pawl 29 is of lever-type design and has a first end or first limb 30 and a second end or second limb 31 extending in the opposite direction. At the centre, the pawl 29 can be pivoted about a pivot 32, which is mounted on the handle 2, more specifically in the region of the opening 18. The first limb 30 of the pawl 29 thus points towards the inside of the handle 2 and forwards, while the second limb 31 of the pawl 29 comes to lie outside the handle 2 and points towards the rear end of the screwing tool. In this arrangement, the second limb 31 comes to lie above that rim 5 of the base shell 3 which delimits the opening 18 on one side. Between this region of the rim 5 and the second limb 31, which comes to rest above it, there is a compression spring 33, which attempts to pivot the pawl 29 about the pivot 32 in the anticlockwise direction in FIGS. 3 and 4 in order to press the first limb 30 inwards. If the second limb 31 is pressed from outside by a user, more specifically counter to the force of the compression spring 33, the first limb 30 is pivoted outwards. At its free end, this first limb 30 is designed as a pawl or latching nose, which engages in a row of teeth 34 on that surface of the actuating member 12 which faces the pawl 29. In the through opening 16 there is only the actuating member 12, which can be displaced in a sliding manner on the surface of the stop 9 by means of its surface facing away from the row of teeth 34. The actuating member 12 is constructed essentially in the manner of a flat bar and, at its end projecting from the through opening 16, has a portion 12*a* angled towards the clamping hoop 8. This portion 12*a* can be used to grasp the actuating member 12 and pull it out of or push it into the through opening 16 when the first limb 30 is out of engagement with the row of teeth 34.

In front of and behind the pawl 29 on the outside of the rim 5 there are furthermore beads 35, 36, which prevents a user from unintentionally actuating the second limb 31 while operating the screwing tool.

It should furthermore be pointed out that those regions of the clamping hoop 8 and the actuating member 12 which come to lie outside the housing 2 can be made wider than the housing 2 itself in order to ensure improved transmission of force to the component to be screwed.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A screwing tool comprising:

a handle;

a clamping hoop pivotably mounted at one end on the handle and being bent in the form of a partial circle at an end remote from the handle;

a stop for the clamping hoop, the stop being secured on the handle on a concave side of the clamping hoop;

a return device on the handle, the return device presses the clamping hoop against the stop; and an actuating member, which is held by the handle and a free end of which lies opposite to and at a distance from the concave side of the clamping hoop.

2. The screwing tool according to claim 1, further comprising driver projections on a free end of the clamping hoop, the driver projections being in the form of a partial circle on the concave side of the clamping hoop, the driver projections being spaced apart in a circumferential direction.

3. The screwing tool according to claim 2, wherein a free end of the clamping hoop is bent in the form of a partial circle, the driver projections initially rising slowly and then falling rapidly in the circumferential direction of the clamping hoop.

4. The screwing tool according to claim 1, wherein the clamping hoop and the actuating member lie in a same working plane.

5. The screwing tool according to claim 4, wherein the handle also extends in the working plane.

6. The screwing tool according to claim 1, wherein the return device is a compression spring that lies between a convex side of the clamping hoop and the handle.

7. The screwing tool according to claim 1, wherein the handle is in the form of a housing.

8. The screwing tool according to claim 7, wherein the handle has a chamber for accommodating a second clamping hoop.

9. The screwing tool according to claim 1, wherein the actuating member is displaceably mounted for adjustment of a distance between a free end thereof and the end of the clamping hoop which is bent in the form of a partial circle.

10. The screwing tool according to claim 9, further comprising a device for locking a displacement position of the actuating member, the device for locking being on the handle.

11. The screwing tool according to claim 10, wherein the device for locking has a pawl pivotably mounted on the handle with one end which is latchable to the actuating member.

12. The screwing tool according to claim 11, wherein the pawl is pivotable into a locking position by a spring at one end thereof, the spring projects from the handle.

13. The screwing tool according to claim 12, wherein the device for locking is secured by protrusions situated to a side thereof on an outside of the handle.

14. The screwing tool according to claim 10, wherein the device for locking is secured by protrusions situated to a side thereof on an outside of the handle.

* * * * *